US005823039A

United States Patent [19]

Umeda et al.

[11] Patent Number: 5,823,039

[45] Date of Patent: Oct. 20, 1998

[54] APPARATUS FOR DRAWING WIRE USING A HEATED DRAWING DIE AND COOLING DEVICE

[75] Inventors: Katsumi Umeda; Kanji Umekawa; Yasushi Umeda; Shiro Kono, all of Yokohama, Japan

[73] Assignee: Noge Electric Industries Co., Ltd., Yokohama, Japan

[21] Appl. No.: 871,417

[22] Filed: Jun. 9, 1997

Related U.S. Application Data

[63] Continuation of Ser. No. 384,982, Feb. 7, 1995, abandoned.

[51] Int. Cl.[6] ..... B21C 9/00

[52] U.S. Cl. ..... 72/286

[58] Field of Search ..... 72/286, 280, 18.3, 72/19.1, 16.5

[56] References Cited

U.S. PATENT DOCUMENTS

| | | | |
|---|---|---|---|
| Re. 20,067 | 8/1936 | Busey | 72/286 |
| 3,774,436 | 11/1973 | Tviksta | 72/286 |
| 3,946,582 | 3/1976 | Pietroni | 72/286 |
| 4,036,046 | 7/1977 | Davies | 72/286 |
| 4,464,992 | 8/1984 | Pamplin | 72/286 |
| 4,644,769 | 2/1987 | Pamplin | 72/286 |
| 4,739,640 | 4/1988 | Hurst | 72/286 |

FOREIGN PATENT DOCUMENTS

| | | | |
|---|---|---|---|
| 215483 | 11/1984 | German Dem. Rep. | 72/286 |
| 2538177 | 5/1976 | Germany | 72/286 |
| 20053 | 2/1976 | Japan | 72/286 |
| 20054 | 2/1976 | Japan | 72/286 |
| 269926 | 11/1986 | Japan | 72/286 |
| 199216 | 9/1987 | Japan | 72/286 |
| 583978 | 1/1947 | United Kingdom | 72/286 |

*Primary Examiner*—Daniel C. Crane
*Attorney, Agent, or Firm*—Pennie & Edmonds LLP

[57] ABSTRACT

A working method for wire drawing, applicable even to alloys such as Au—Sn and Au—Si which are fragile and which have their tensile strengths lowered rapidly when heated. A die and wire to-be-pulled are heated by a heating device so as to increase the ductility of the wire. On the other hand, finished wire having just been pulled out of the die is cooled by a cooling device so as to increase the tensile strength of the wire. Thus, the wire material can be easily worked owing to the increased ductility, while it can be prevented from breaking after the working, owing to the increased tensile strength based on the immediate cooling. Accordingly, the wire drawing works of the Au—Sn alloy etc. are permitted.

4 Claims, 4 Drawing Sheets

APPARATUS FOR DRAWING WIRE USING A HEATED DRAWING DIE AND COOLING DEVICE

This is a continuation of application Ser. No. 08/384,982, filed Feb. 7, 1995, now abandoned.

BACKGROUND OF THE INVENTION

1. Field of the Invention

The present invention relates to a working method and a working apparatus for wire drawing. More particularly, it relates to a method and an apparatus which are well suited for the wire drawing of a fragile alloy such as Au—Sn.

2. Description of the Related Art

A so-called "wire drawing process" has been extensively employed as a method for manufacturing a wire product.

The wire drawing process is a method wherein a wire material before working is pulled through an aperture smaller in diameter than the wire material, thereby fining this wire material down to the diameter of the aperture. Incidentally, in this specification, the wire material before the working by a die shall be sometimes called the "wire to-be-pulled" (as a raw material), and the wire material after the working the "finished wire" (as a product).

For applying the wire drawing process, however, it is required that the wire to-be-pulled itself has sufficient ductility to be drawn, while at the same time, the finished wire has sufficient tensile strength to endure the wire drawing. The reason therefor is that, although the wire to-be-pulled must be pulled through the die aperture by a force whose magnitude conforms to the ductility, the finished wire will sever if the magnitude of the force exceeds the tensile strength.

Besides, even an alloy of low ductility ought to be, in principle, capable of wire drawing when pulled within the limit of the tensile strength. However, when the rate of the wire drawing is intended to be increased, a tensile load on the wire to-be-pulled of the alloy increases. In order to work the alloy at a satisfactory wire drawing rate in practical use, the absolute values of the ductility and the tensile strength also need to be large to some extent.

Accordingly, it has hitherto been impossible to perform the wire drawing work of a fragile material (for example, an alloy such as Au—Sn, Au—Si or Au—Ge). It is also considered to enhance the ductility by heating. Since, however, such a material has its tensile strength lowered sharply with a temperature rise, the wire drawing work thereof has proved difficult. The difficulty augments especially as the diameter of the wire material becomes small. By way of example, regarding the wire material Au—Sn, a wire product which is finer than $\phi$0.25 mm [0.25 (mm) in diameter] has not been obtained in the present situation.

In spite of such circumstances, regarding the alloys Au—Sn etc. extensively employed as brazing materials, very fine wire products are eagerly requested in order to promote the automation of brazing processes.

SUMMARY OF THE INVENTION

The present invention has for its object to provide a working method and a working apparatus for wire drawing which are applicable to materials (for example, alloys Au—Sn, Au—Si and Au—Ge) each having been presenting difficulties in wire drawing work on account of, e. g., the problem concerning the balance between the ductility and the tensile strength thereof.

Another object of the present invention is to provide the wire materials of low-fusing alloys such as Au—Sn for use in brazing, especially a wire material suitable for the brazing of a very fine part.

In one aspect of the present invention which has been made for accomplishing the above objects, there is provided a working apparatus for wire drawing wherein a wire material is fined, comprising a delivery device which delivers the wire material as a starting material; a die which is formed with an aperture for plastic working of reducing a diameter of the wire material; a pulling device by which the wire material delivered from the delivery device is pulled through the aperture at a predetermined speed; a takeup device which takes up the wire material having been pulled through the aperture by the pulling device; a first temperature control device by which a temperature of a part of the wire material lying in the aperture is held within a predetermined range; and a second temperature control device by which a temperature of a part of the wire material having just been pulled out of the die is held at, at most, a predetermined value.

Preferably, the first temperature control device includes heating means for heating at least either of the die and that part of the wire material which lies on this side of the die with respect to the delivery device, while the second temperature control device includes cooling means for cooling that part of the wire material which has just been pulled out of the die (hereinbelow, termed "the part to-be-cooled").

The cooling means should preferably cool the part to-be-cooled down to a temperature at which a tensile strength of the part to-be-cooled becomes greater than a tension acting on the part to-be-cooled, at a part of the wire material extending, at least, between the pulling device and the die.

The cooling means may well cool the part to-be-cooled by holding a cooling fluid in touch therewith.

In the second aspect of the present invention, there is provided a working method for wire drawing wherein a wire material is fined by pulling it through an aperture of a die, comprising the steps of holding a temperature of the wire material passing through the aperture, within a predetermined range; and holding a temperature of the wire material immediately after having been pulled out of the die, so as not to exceed a predetermined value.

In the third aspect of the present invention, there is provided a working method for wire drawing wherein a wire material is fined by pulling it through an aperture of a die, comprising the step of blowing a fluid against the wire material immediately after having been pulled out of the die.

In the fourth aspect of the present invention, there is provided a working apparatus for wire drawing wherein a wire material is fined, comprising a delivery device which delivers the wire material as a starting material; a die which is formed with an aperture for reducing a diameter of the wire material by plastic working; a pulling device by which the wire material delivered from the delivery device is pulled through the aperture at a predetermined speed; a takeup device which takes up the wire material having been pulled through the aperture by the pulling device; and cooling means for cooling that part of the wire material which has just been pulled out of the die (hereinbelow, termed "the part to-be-cooled").

The cooling means may well blow a cooling fluid against the part to-be-cooled.

It is also allowed to further comprise heating means for heating at least either of the die and that part of the wire material which lies on this side of the die with respect to the delivery device.

In operation, the wire material and the die are heated (the temperatures thereof are controlled) by the first temperature control device so as to fall within the predetermined temperature range. Thus, the ductility of the wire material at the position of the aperture of the die can be made suitable for the wire drawing so as to facilitate the wire drawing work.

Besides, the wire material having just undergone the plastic working, in other words, having just come out of the die, is cooled (the temperature thereof is controlled) by the second temperature control device. The cooling in this case is performed down to the temperature at which the tensile strength of the part to-be-cooled becomes, at least, greater than the tension acting on the part to-be-cooled. Thus, the wire material recovers its tensile strength and therefore undergoes no breaking. The cooling can be realized by, for example, blowing the fluid against the part to-be-cooled.

A material such as solder has hitherto been incapable of wire drawing because it exhibits an insufficient tensile strength in spite of possessing a sufficient ductility for the wire drawing even at the normal temperature. For such a material, the heating before the wire drawing step is unnecessary, and only the cooling after the wire drawing step may be carried out.

According to the present invention, the wire drawing work is permitted even for a material tensile strength which is lowered in excess of the increase of the ductility thereof with a temperature rise (for example, a low-fusing alloy such as Au—Sn, Au—Si or Au—Ge). Moreover, it may suffice for the construction of the working apparatus to merely add the cooling device to a wire drawing apparatus having heretofore existed, so that the cost of installation and the cost of manufacture can be suppressed.

PREFERRED EMBODIMENTS OF THE INVENTION

An embodiment of the present invention will be described in conjunction with the accompanying drawings.

Conditions which are necessary for wire drawing work (here, characteristics which are required of a material itself) are not always identical throughout the working process. A wire drawing apparatus according to the present invention features that, with note taken of the above fact, condition controls are performed independently at the individual steps of the working process. More specifically, the material is controlled so as to establish a state of higher ductility at a part which undergoes wire drawing, and a state of high tensile strength at a part which has just undergone the wire drawing. Actually, the controls are implemented by independently controlling the temperatures of the material before and after the wire drawing work.

Now, this embodiment will be concretely described.

Figure 1:
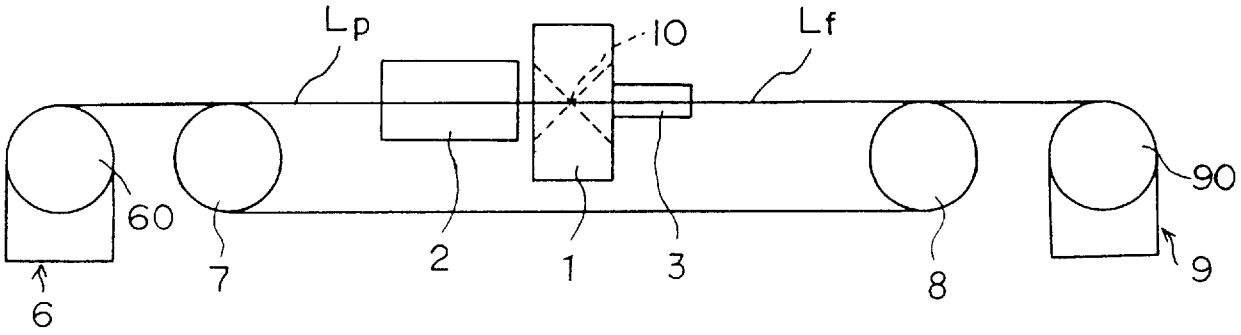
FIG. 1 is a schematic side view showing a wire drawing apparatus which is an embodiment of the present invention.

The wire drawing apparatus of this embodiment is schematically illustrated in FIG. 1. It is mainly constructed of a die 1, a heating device 2, a cooling device 3, a delivery device 6, a reel 7, a capstan 8 and a takeup device 9.

The die 1 serves to perform the plastic working (wire drawing) of reducing the diameter of a wire material. This die 1 is provided with an aperture 10 corresponding to the diameter of desired wire, and wire to-be-pulled Lp is turned into the wire of the predetermined diameter by being passed through the aperture 10.

The heating device 2 serves to heat the die 1 and the wire to-be-pulled Lp for the purpose of facilitating the wire drawing. Owing to the temperature control (in this case, heating), that part of the wire to-be-pulled Lp which lies in the aperture 10 can be brought to a temperature at which the wire part possesses a ductility suitable for the wire drawing. Herein, the tensile strength of the wire to-be-pulled Lp lowers due to the heating. Since, however, a very great tension does not act on the wire to-be-pulled Lp on this side of the die 1 with respect to the delivery device 6, breaking etc. of the wire Lp does not occur.

Figure 2:
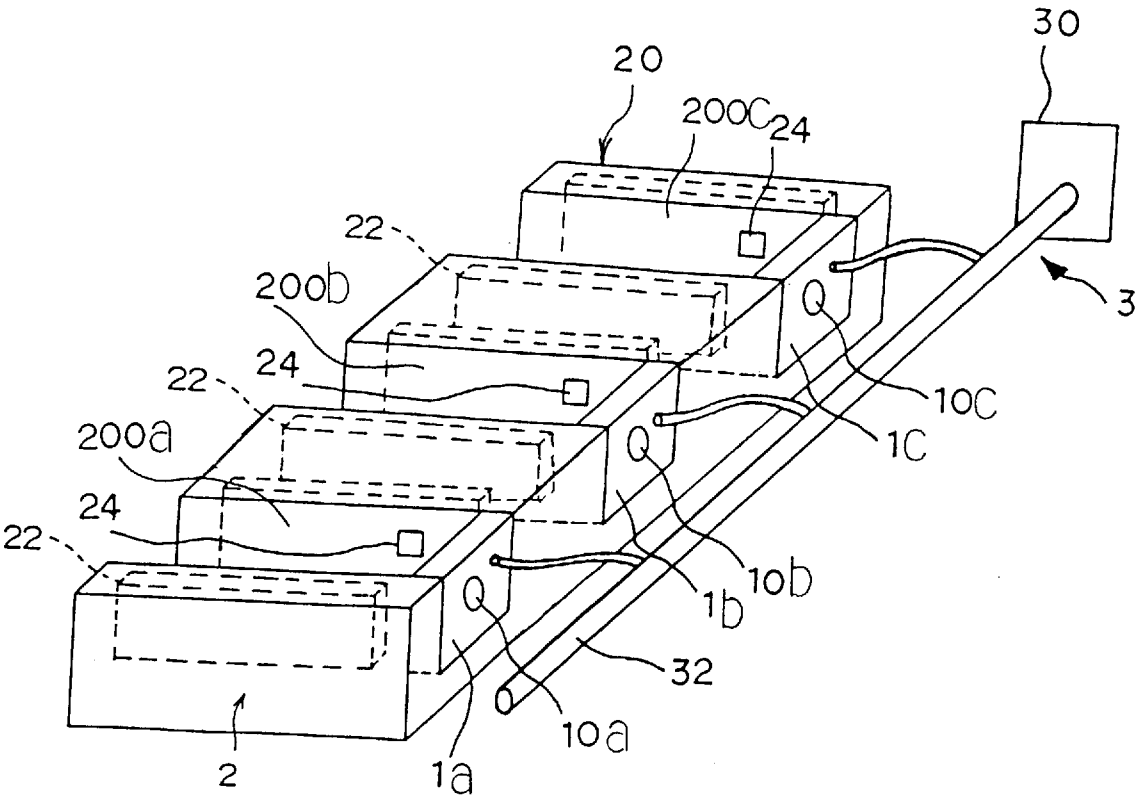
FIG. 2 is a perspective view showing the details of a heating device (2), a die (1) and a cooling device (3) which are comprised in the embodiment.

As illustrated in FIG. 2, the heating device 2 includes a base 20 which is formed with a groove 200 for passing the wire to-be-pulled Lp therethrough, and heaters 22 which are mounted (for example, embedded) in the base 20. Further, the heating device 2 includes a temperature sensor 24 and a temperature control circuit (not shown), whereby the temperatures of the die 1 and the inwalls of the base 20 defining the groove 200 are precisely controllable. Regarding the heaters 22 and the temperature control mechanism themselves, conventional ones can be used. The die 1 is located at one end of the groove 200. The practicable setup of the heating device 2 is not restricted to the illustrated one. By way of example, hot air may well be blown against the die 1 and/or the part of the wire Lp lying on this side of the die 1. The heating device 2 corresponds to the "first temperature control device" mentioned in the appended claims.

Here in this embodiment, the base 20 is provided with a plurality of grooves 200*a* to 200*c* and dies 1*a* to 1*c*. Therefore, a wire drawing work of multiple stages can be continuously carried out by reciprocating the wire material between the capstan 8 and the reel 7 as will be explained later. Besides, in consequence of such an apparatus configuration, heating (or cooling) operations at all the stages can be effected by substantially the single heating device 2 (or cooling device 3), and the cost of installation can be curtailed. In addition, since the temperatures can be collectively managed, they can be controlled with ease. Further, the occupation area of the apparatus can be reduced.

The cooling device 3 serves to cool that part of the finished wire (the desired wire mentioned before) Lf which has just passed through the aperture 10 of the die 1. The finished wire Lf having passed through the aperture 10 has its tensile strength (per unit cross-sectional area) increased again by being cooled. Such a temperature control (here, cooling) is performed for the reason that, since the finished wire Lf having passed through the die 1 is directly submitted to a tensile load exerted by the capstan 8, sufficient tensile strength to endure the tensile load is required first of all. When the cooling by the cooling device 3 is carried out for a wire part having already lain remote from the die 1, it is apprehended that the finished wire Lf will sever on its side nearer the die 1 than the cooled wire part. Accordingly, the cooling needs to be carried out for the wire part having just come out of the aperture 10, as far as possible. By the way, although the ductility of the finished wire Lf lowers with the temperature fall thereof based on the cooling, no hindrance is formed because the wire Lf has already passed through the die 1.

In this embodiment, the cooling device 3 is mainly constituted by an air blower 30 and a nozzle 32 (refer to FIG. 2). The nozzle 32 confronts the outlet part of the aperture 10, and it sends a wind generated by the air blower 30, concentrically to the outlet part, thereby immediately cooling the wire part which has just been pulled out of the aperture 10. In this embodiment, the nozzle 32 used is formed with nozzle tip holes which have an inside diameter of 1.5 (mm). The practicable setup of the cooling device 3 is not restricted to the illustrated one. By way of example, more efficient cooling is permitted when a heat pump is mounted so as to blow cold air against the wire part having just come out of the aperture 10. Further, the cooling may well be carried out by employing a liquid such as water, oil or liquid nitrogen. The cooling device 3 corresponds to the "second temperature control device" or the "cooling means" mentioned in the appended claims. Besides, the wind (air), water, oil or liquid nitrogen stated here corresponds to the "cooling fluid" mentioned in the appended claims.

Incidentally, the conditions of the heating and cooling are determined on the basis of the relationships of the finished wire Lf with the tensile strength, tension etc. These points will be explained in detail later by the use of concrete data.

The heating by the heating device 2 and the cooling by the cooling device 3 in this embodiment are not performed while the temperatures of the wire material are being directly measured. However, various conditions (for example, a wire drawing speed, an air blowing quantity and a heating quantity) are accurately prescribed and controlled, whereby the temperatures of the wire parts can be respectively controlled into the predetermined temperature ranges though indirectly. When the temperatures of the wire material are directly measured, more precise temperature controls are possible. The direct measurements of the temperatures of the wire material during the wire drawing can be realized using infrared thermometers or the like.

The delivery device 6 delivers the wire to-be-pulled Lp wound round a reel 60, in succession while affording a back tension thereto. As already stated, the tensile strength of the wire to-be-pulled Lp is lowered by the heating of the heating device 2. Accordingly, the delivery should preferably proceed while the tension (back tension) to act on the wire to-be-pulled Lp is being controlled so as not to become excessively great.

The capstan 8 serves to pull the finished wire Lf in order that the wire to-be-pulled Lp continuous thereto may be subjected to the wire drawing work by the die 1. This capstan 8 is furnished with drive means such as an electric motor, and it rotates with a driving force, thereby pulling the finished wire Lf. Accordingly, the wire drawing speed can be adjusted by controlling (or altering) the speed of the rotation of the capstan 8 and the friction coefficient of the outer surface thereof. The turning force of the capstan 8 acts on the finished wire Lf as the tensile load, without attenuating appreciably. When the wire drawing speed is high, the tension to act on the finished wire Lf increases, and the severance of the finished wire Lf is apprehended. Therefore, the finished wire Lf must be pulled while the tension to act on the finished wire Lf is being controlled so as not to exceed the tensile strength of this wire Lf having been cooled. Besides, when the wire drawing speed fluctuates, nonuniformity in the diameter of the finished wire Lf, etc. arises. Especially in this embodiment, the fluctuation of the wire drawing speed is greatly influential because it fluctuates the heating and cooling conditions explained above. Therefore, the capstan 8 needs to be controlled at the highest possible precision so as to rotate at the predetermined speed. In this regard, since the degrees of the heating of the wire to-be-pulled Lp and the cooling of the finished wire Lf change depending upon the magnitude of the wire drawing speed, this wire drawing speed must be determined while also considering the heating capacity of the heating device 2 and the cooling capacity of the cooling device 3. Incidentally, the capstan 8 corresponds to the "pulling device" mentioned in the appended claims.

The reel 7 serves to guide the finished wire Lf turned back by the capstan 8, to the die 1 of the next stage by turning this wire Lf forwards again. Herein, the reel 7 itself rotates in accordance with the movement of the finished wire Lf and does not rotate with its own driving force.

Since, as stated before, the wire drawing work of the three stages is continuously performed in this embodiment, the finished wire Lf is turned back and forwards by the capstan 8 and the reel 7, respectively, and is guided to the dies 1 of the succeeding stages. Accordingly, the finished wire Lf of the preceding stage becomes the wire to-be-pulled Lp at the succeeding stage. The effect of an enhanced job efficiency can be attained by performing the multistage wire drawing steps consecutively in this manner. Incidentally, the number of stages of the work can be properly altered as required.

The takeup device 9 serves to take up the finished wire Lf that is finally completed (as a wire product), round a reel 90. Needless to say, the takeup by the takeup device 9 proceeds under a control under which an unnecessarily great tension is prevented from acting on the finished wire Lf having come out of the final stage.

Now, the process of the wire drawing work will be described.

As a preparatory stage, the heaters 22 of the heating device 2 are actuated to preheat the dies 1 and the inwalls of the base 20 defining the grooves 200, to a predetermined temperature. The air blower 30 of the cooling device 3 is also actuated to establish the state in which the wire material having come out of the dies 1 can be cooled anytime.

After the above preparation, the apparatus starts pulling the wire material by means of the capstan 8. At the same time, the wire to-be-pulled Lp wound round the reel 60 is successively delivered by the delivery device 6.

In passing through the groove 200 (first-stage groove 200*a*) of the heating device 2, the wire to-be-pulled Lp delivered from the reel 60 is heated to a certain extent by radiation heat from the inwalls of the groove 200, etc. Herein, since the heating device 2 is furnished with the temperature control circuit, the wire to-be-pulled Lp is not heated more than is needed.

The heated wire to-be-pulled Lp is subjected to the wire drawing by passing through the die 1 (first-stage die 1*a*) which is similarly heated. The wire to-be-pulled Lp is easily subjected to the wire drawing because its ductility has been increased.

The finished wire Lf pulled out of the die 1 is cooled to or below a predetermined temperature by the cooling device 3 immediately after having come out of the die 1. As a result, the finished wire Lf recovers its tensile strength sufficient to endure a tension to which it is submitted on this occasion, so that it is pulled and advanced by the capstan 8 without breaking. Thereafter, the finished wire Lf is turned back and forwards by the capstan 8 and the reel 7, respectively, and it is subjected to the wire drawing by the die 1 of the next stage in conformity with the same processing steps. The heating of the wire to-be-pulled Lp and the cooling of the finished wire Lf are naturally done anew every stage.

After the wire drawing of the final stage has been carried out, the finished wire Lf (as the wire product) is taken up on the reel 90 of the takeup device 9 directly without being turned back by the capstan 8.

There will now be described practicable conditions relevant to the heating and cooling which serve to permit the wire drawing work explained above.

In order to perform the wire drawing work, the tensile strength of the finished wire Lf must be greater than the tension which actually acts on this finished wire Lf.

Figure 3:
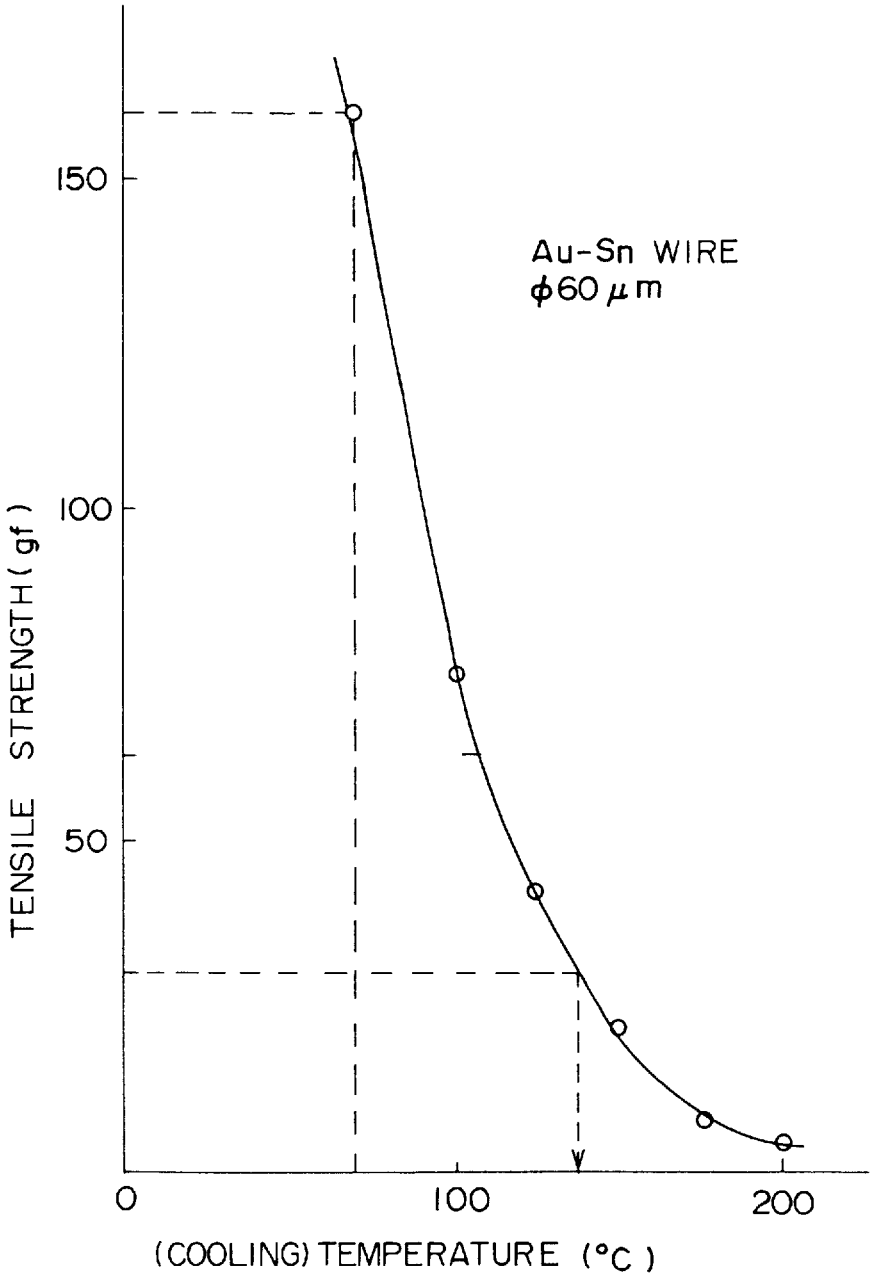
FIG. 3 is a graph showing the relationship between the tensile strength and the temperature of Au—Sn wire.

The tensile strength of the finished wire Lf changes depending chiefly upon the diameter and temperature thereof. FIG. 3 exemplifies the relationship between the tensile strength (in grams-force) and the temperature (in °C.) of Au (80 wt %)–Sn (20 wt %) wire of ϕ60 μm (60 μm in diameter). In spite of the cooling by the cooling device 3, the finished wire Lf is considered to be weakest at the objective part of the cooling (namely, the part having just passed through the die 1). By the way, the data indicated in the graph of FIG. 3 were measured using a tensile testing machine, and the measurement was conducted by heating each test piece wholly, not by heating only part thereof.

Figure 4:
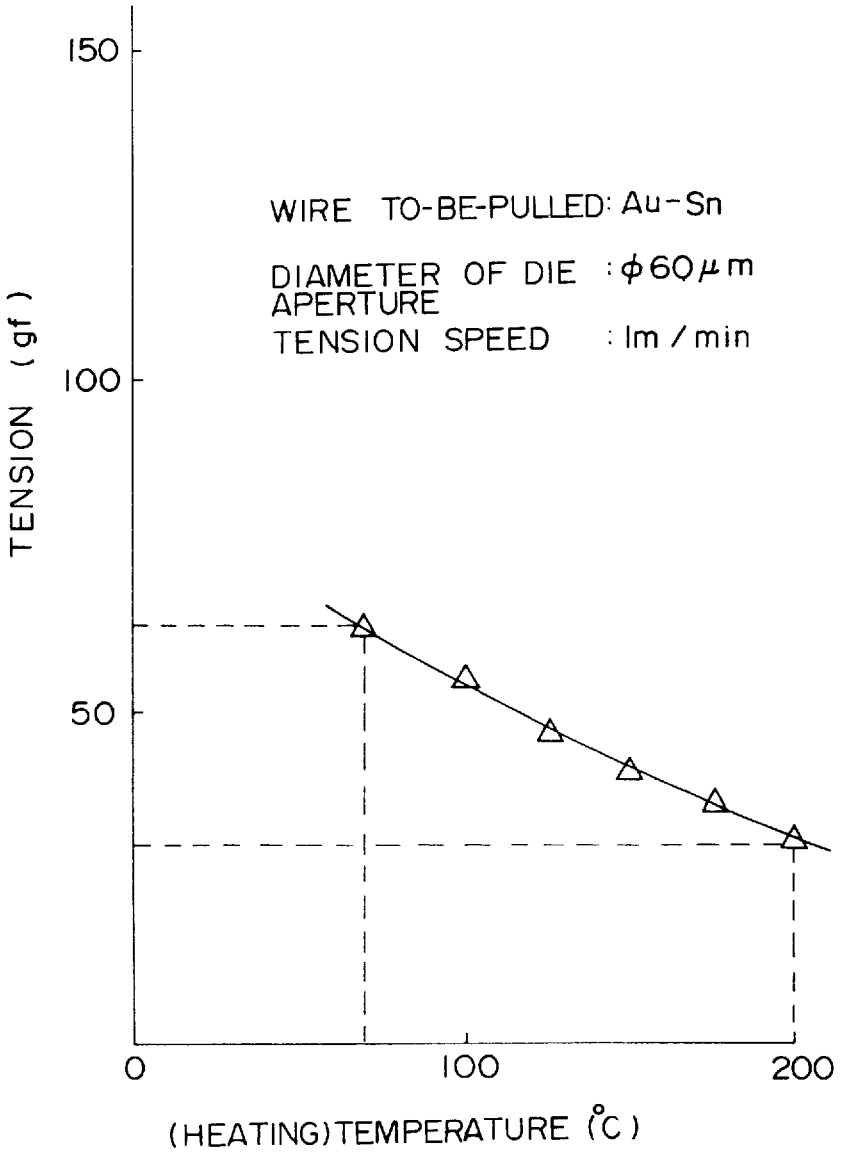
FIG. 4 is a graph showing the relationship between a tension acting on finished wire (Lf) and a temperature for heating the wire to-be-pulled (Lp) in the case of performing the wire drawing of Au—Sn wire.

On the other hand, the magnitude of the tension which actually acts on the finished wire Lf changes depending upon, not only the diameter thereof and the wire drawing speed, but also the ductility (namely, the temperature) of the wire to-be-pulled Lp. In an example, therefore, Au (80 wt %)–Sn (20 wt %) wire of ϕ62.1 μm was fined into a wire product of ϕ60 μm by a wire drawing work conducted at a speed of 1 (m/min). FIG. 4 illustrates results obtained by measuring the relationship between the tension acting on the finished wire Lf and the temperature of the wire to-be-pulled Lp in the example. Here in the measurement, the finished wire Lf was cooled in order to prevent this finished wire Lf from severing. Since, however, the cooling is done behind the die 1 (relative to the delivery device 6) to the last, it does not affect the measured results.

The conditions of the heating and cooling can be determined by comparing the graphs of FIGS. 3 and 4. In a case, for example, where the wire to-be-pulled Lp has been heated up to 200 (°C.) by the heating device 2, it is submitted to a tension of about 30 (gf) as seen from FIG. 4. Consequently, the finished wire Lf must possess a tensile strength of or above 30 (gf) even at the weakest part, namely, the part being cooled. To this end, the finished wire Lf must be cooled down to, at least, about 140 (°C.) as seen from FIG. 3.

In another case, for example, where the wire to-be-pulled Lp has been heated up to 70 (°C.) by the heating device 2, it is submitted to a tension of about 63 (gf) as seen from FIG. 4. It is seen from FIG. 3 that the finished wire Lf exhibits a tensile strength of 160 (gf) at 70 (°C.). In this case, accordingly, the cooling is not necessary.

In the actual process for manufacture, however, various forces such as a torsional force and shocks attendant upon the start and stop of the apparatus act in addition to the tensile force. In preparation for the additional forces, accordingly, the finished wire Lf need to be cooled down to a temperature which is lower than the temperature obtained from the graphs of FIGS. 3 and 4. By the way, the heating temperature can be set at an appropriate value in consideration of a wire drawing speed required, the cooling capacity of the cooling device 3, etc. Needless to say, the heating temperature must not become excessively close to the fusing point of the wire material.

Here, only the data in the case of the wire drawing speed of 1 (m/min) have been indicated. As already stated, however, when the wire drawing speed is increased with the other conditions held identical, the tension to act on the finished wire Lf increases (this corresponds to the fact that the curve of the relationship shown in FIG. 4 shifts upwards). Accordingly, the cooling needs to be intensified for raising the wire drawing speed.

The extents of the heating of the wire to-be-pulled Lp and the cooling of the finished wire Lf change depending upon the magnitudes of a delivery speed and a takeup speed (the wire drawing speed). By way of example, when the wire drawing speed is increased, time periods for which the wire material is heated and cooled shorten, and hence, the heating and cooling become accordingly more difficult. Also, the quantity of frictional heat developing at the wire drawing step changes depending upon the wire drawing speed, etc. Accordingly, the actual wire drawing speed and temperature controls (heating, cooling) must be set after the various conditions have been judged overall.

The inventor of the present invention actually performed a wire drawing work by the use of a wire drawing apparatus to which the present invention was applied. As a result, Au (80 wt %)–Sn (20 wt %) wire of ϕ1.0 mm (1.0 mm in diameter) could be finally turned into very fine wire having a diameter of 18 (μm) and a length of 200 (m), without breaking midway. Incidentally, the length of 200 (m) was based on the limited length of the wire to-be-pulled used in the wire drawing work and was not ascribable to breaking. Concrete conditions in the wire drawing work were as follows:

Number of the stages of dies: 50

Heating temperatures: 70° to 200° C.

Cooling method: Air blowing cooling (air at 20° to 30° C., 4 to 7 liters/minute, nozzle tip holes having an inside diameter of 1.5 mm)

Wire drawing speed: 1 to 20 m/minute

In the embodiment described before, the wire drawing is facilitated by heating the wire material. Besides, the wire material has its tensile strength increased and is prevented from breaking, by cooling it immediately after passing through the die. Accordingly, the wire drawing steps can be consecutively carried out without breaking while a practical wire drawing speed is ensured.

In the above description, the alloy Au (80 wt %)–Sn (20 wt %) has been taken as an example. The present invention, however, is similarly applicable also to the wire drawing work of any other material (for example, an alloy such as Au—Si or Au—Ge) which is fragile at room temperature, and which increases in ductility but greatly lowers in tensile strength with a temperature rise.

Since the wire drawing apparatus of the foregoing embodiment can be constructed merely by adding the cooling device and the heating device to a conventional wire drawing apparatus, the cost of installation required anew may be low. Accordingly, the cost of manufacture can be suppressed. Incidentally, the practicable setups and arrangement of the heating device 2, die 1 and cooling device 3 in the embodiment are mere examples, and the present invention is not restricted to them.

The very fine wire of the low-fusing alloy such as Au (80 wt %)–Sn (20 wt %) fabricated by the foregoing method can be used as a brazing material. With the very fine wire of the low-fusing alloy, the continuous supply of the brazing material is permitted, so that a brazing process can be automated and speeded up.

The foregoing embodiment has referred to the wire drawing directed to the material which exhibits the satisfactory ductility for the first time by being heated, but the tensile strength of which lowers greatly in the meantime. The present invention, however, is also applicable to a material, such as solder, which has sufficient ductility for wire drawing even at the normal temperature, but which has hitherto been unsuitable for wire drawing merely due to an insufficient tensile strength. By way of example, the solder may be only cooled immediately after the wire drawing step by the die. Since the solder has sufficient ductility even at the normal temperature, the die etc. need not be heated.

What is claimed is:

1. A working apparatus for wire drawing wherein wire material is fined, comprising:

a delivery device for delivering such wire material as a starting material;

a die having an aperture for plastic working to reduce a diameter of such wire material;

a pulling device for pulling such wire material delivered from said delivery device through said aperture at a predetermined speed;

a takeup device for taking up such wire material pulled through said aperture by said pulling device;

heating means for heating said die;

heating control means for controlling said heating means to control the temperature of said die so that a part of the wire material lying in said aperture is heated by said heating means to be at a temperature within a predetermined range; and cooling means for cooling a part of such wire material having just been pulled out of said die ("part-to-be-cooled") so that the temperature of the part-to-be-cooled is lowered below a predetermined value.

2. A working apparatus for wire drawing as defined in claim 1, wherein said cooling means cools said part-to-be-cooled down to a temperature at which a tensile strength of said part-to-be-cooled becomes greater than a tension acting on said part-to-be-cooled, at a part of the wire material extending, at least, between said pulling device and said die.

3. A working apparatus for wire drawing as defined in claim 1, wherein said cooling means cools said part-to-be-cooled by holding a cooling fluid in contact therewith.

4. A working apparatus for wire drawing as defined in claim 1, further comprising a returning device and a plurality of said dies each having an aperture, wherein:

said plurality of dies are arranged in a vertical direction with regard to said wire material delivered from said delivery device, between said returning device and said pulling device;

said pulling device pulls said wire material delivered from said delivery device through one of said apertures at a predetermined speed and sends the wire material back toward said delivery device;

said returning device delivers said wire material sent back toward said delivery device by said pulling device to another one of said apertures of said plurality of dies; and said takeup device takes up the wire material having been pulled through all of said apertures of said plurality of dies by said pulling device.

* * * * *